United States Patent [19]

Wilkinson

[11] 4,154,212

[45] May 15, 1979

[54] FUEL BURNING HEATER

[75] Inventor: Judkins E. Wilkinson, Birmingham, Ala.

[73] Assignee: Atlanta Stove Works, Inc., Atlanta, Ga.

[21] Appl. No.: 885,589

[22] Filed: Mar. 13, 1978

[51] Int. Cl.[2] ..... F24C 1/14

[52] U.S. Cl. ..... 126/77; 126/80; 126/146; 126/193; 126/198; 126/290

[58] Field of Search ..... 126/77, 80, 83, 198, 126/193, 69, 74, 75, 146, 147, 290

[56] References Cited

U.S. PATENT DOCUMENTS

| | | | |
|---|---|---|---|
| 133,096 | 11/1872 | Harris | 126/83 |
| 544,870 | 8/1895 | Thompson | 126/83 |
| 577,527 | 2/1897 | Hulbert | 126/290 |
| 829,984 | 9/1906 | Manfred | 126/83 |
| 938,543 | 11/1909 | Anthony | 126/193 |
| 1,842,625 | 1/1932 | O'Riley | 126/83 |
| 2,376,409 | 5/1945 | White et al. | 126/290 |
| 2,814,287 | 11/1957 | Shults | 126/290 |

*Primary Examiner*—Carroll B. Dority, Jr.
*Assistant Examiner*—Daniel J. O'Connor
*Attorney, Agent, or Firm*—Woodford R. Thompson, Jr.

[57] ABSTRACT

A fuel burning heater has a lower combustion chamber with a front door and an upper heating chamber with a discharge port at the rear thereof for products of combustion. A common wall between the combustion chamber and the heating chamber defines a top for the combustion chamber and a bottom for the heating chamber. A first discharge passageway through a forward portion of the common wall conveys products of combustion into the forward portion of the heating chamber. A second discharge passageway through a rear portion of the common wall conveys products of combustion into the rear portion of the heating chamber. A damper is mounted in the second discharge passageway for movement selectively toward an open position for faster burning and toward a closed position for slower burning. Lower and upper draft regulators are mounted in lower and upper portions, respectively, of the door for introducing controlled amounts of combustion air.

4 Claims, 5 Drawing Figures

FIG. 3
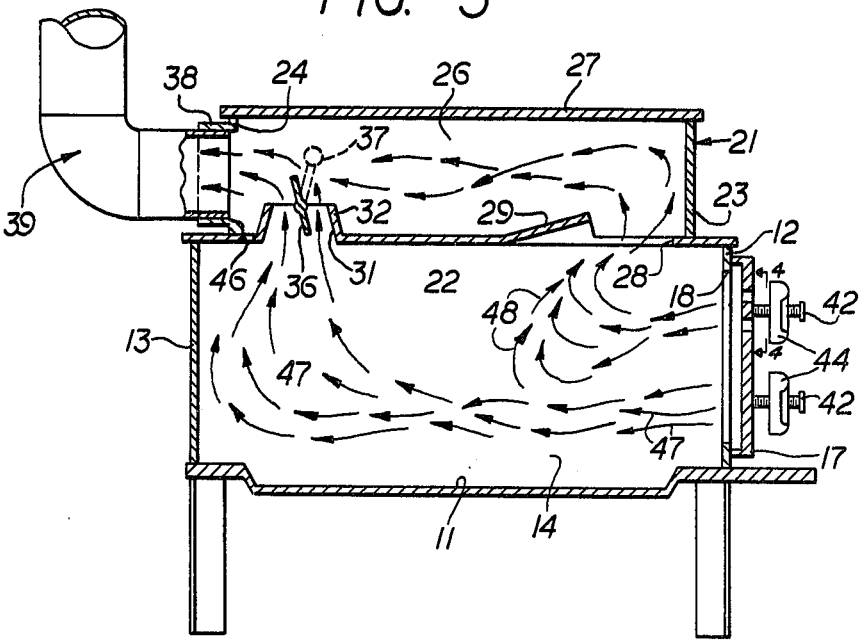
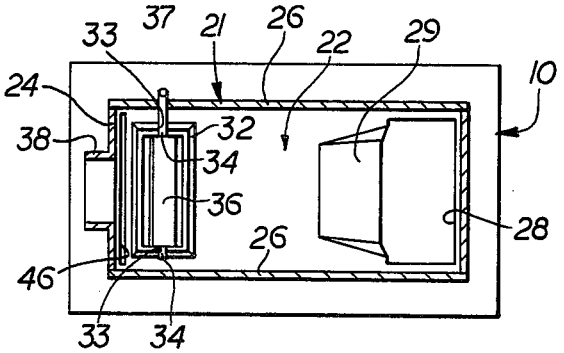
FIG. 5
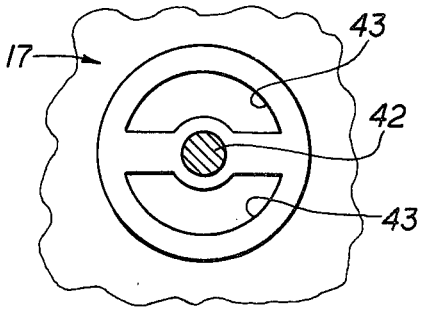
FIG. 4
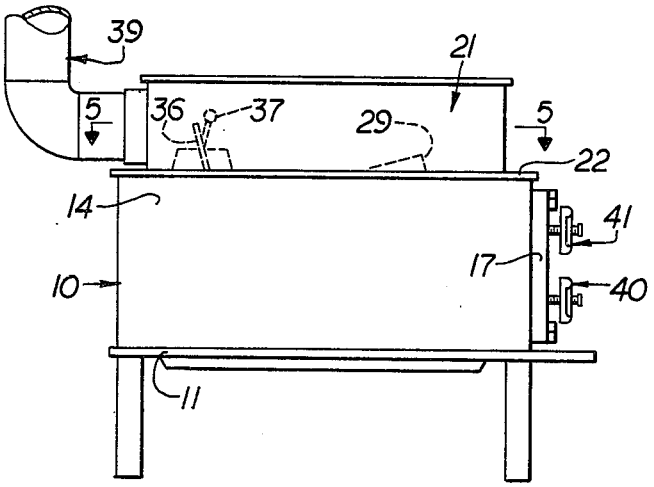
FIG. 1
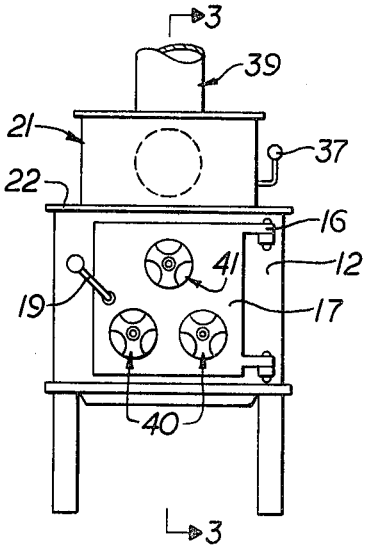
FIG. 2

FUEL BURNING HEATER

BACKGROUND OF THE INVENTION

This invention relates to a fuel burning heater and more particularly to such a heater which shall include improved means for regulating the flow of air through the heater whereby the fuel, such as wood, may be burned at selected rates. For example, by adjusting the draft system to one setting, the combustion air is introduced into the lower, forward portion of a combustion chamber whereby it then flows upwardly through a rear discharge passageway into a heating chamber prior to being discharged. Upon adjusting the drafting system to another setting, the combustion air is introduced into the upper, forward portion of the combustion chamber and moves in a gentle manner above the wood or other fuel and then passes upwardly through a forward discharge passageway into the heating chamber prior to being discharged from the heater.

As is well known in the art to which my invention relates, many fuel burning heaters have been devised wherein the combustion air is circulated in various paths through the heater prior to being discharged. Such prior art heaters are complicated in structure and fail to provide a draft system which provides for both fast starts and quick heat-up and also reduced draft and slow burning when a long sustaining radiant fire is desired. Prior art heaters with which I am familiar are shown in the following U.S. patents: No. 96,328, No. 1,320,276, No. 1,536,786, No. 1,564,567, No. 1,603,925, No. 1,892,015, No. 2,313,370 and No. 2,315,809.

SUMMARY OF THE INVENTION

In accordance with my invention, I provide a fuel burning heater having a lower combustion chamber with a front door and an upper heating chamber with a discharge port for products of combustion at the rear thereof. The heating chamber is separated from the combustion chamber by a common wall which provides a bottom for the heating chamber and a top for the combustion chamber. A first discharge passageway is provided through the common wall adjacent the forward end thereof for conveying at least a portion of the products of combustion from the combustion chamber into the forward portion of the heating chamber whereby the combustion gases and heat from such gases are maintained inside the heater for a longer period of time, thereby minimizing loss of heat through the outlet flue. A second discharge passageway is provided adjacent the rear portion of the common wall for selectively conveying at least a portion of the products of combustion into the rear portion of the heating chamber. Draft regulators are provided in the lower portion of the door of the heater for introducing controlled amounts of combustion air into the lower portion of the combustion chamber whereby such air passes into direct contact with the wood or other fuel and provides for fast burning. A draft regulator is also mounted in the upper portion of the door of the heater for introducing controlled amounts of combustion air into the combustion chamber above the wood or other fuel, thereby reducing the draft and providing secondary combustion air above the burning wood or other fuel whereby burning takes place at a slow rate, thus particularly adapting the furnace for holding a fire at night.

DESCRIPTION OF THE DRAWING

A fuel burning heater embodying features of my invention is illustrated in the accompanying drawing, forming a part of this application, in which:

FIG. 1 is a side elevational view;

FIG. 2 is a front elevational view thereof;

FIG. 3 is an enlarged, sectional view taken generally along the line 3—3 of FIG. 2;

FIG. 4 is an enlarged, fragmental view taken generally along the line 4—4 of FIG. 3; and FIG. 5 is a sectional view taken generally along the line 5—5 of FIG. 1.

DETAILED DESCRIPTION

Referring now to the drawing for a better understanding of my invention, I show a lower housing which defines a combustion chamber 10 having a bottom wall 11 connected to a front wall 12, a rear wall 13 and upstanding side walls 14. Hingedly connected to one side of the front wall 12 by suitable hinges 16 is a door 17 which opens and closes a feed opening 18 provided in the front wall 12, as shown in FIG. 3. The door 17 is provided with a suitable latch member 19 for securing the door in closed position. Mounted above the combustion chamber 10 is an upper housing which defines a heating chamber 21. A common wall 22 is mounted between the combustion chamber 10 and the heating chamber 21 with the central portion of the common wall 22 defining a bottom for the heating chamber 21, as shown in FIGS. 3 and 5. The common wall 22 projects outwardly beyond the bottom of the heating chamber 21 and extends over the combustion chamber 10 to provide an upper wall for the combustion chamber 10. The heating chamber 21 is provided with an upstanding front wall 23, a rear wall 24 and side walls 26 which are connected at their upper ends to a top wall 27.

As shown in FIG. 3, a discharge passageway 28 is provided through the front portion of the common wall 22 for conveying products of combustion from the combustion chamber 10 into the forward portion of the heating chamber 21. As shown in FIG. 3, an upwardly and forwardly extending deflector member 29 is carried by the common wall 22 adjacent the rearmost side of the discharge passageway 28 in position to direct the products of combustion toward the front end of the heating chamber 21.

A discharge passageway 31 is provided through the rear portion of the common wall 22, as shown in FIG. 3, for conveying products of combustion from the rear portion of the combustion chamber 10 into the rear portion of the heating chamber 21. An upstanding flange 32 surrounds the discharge passageway 31 and is provided with upwardly opening recesses 33 at opposite sides thereof for receiving suitable bearing supports 34 carried by a damper blade 36. The damper blade 36 is connected to a control handle 37 which extends outwardly of the heating chamber 21, as shown in FIG. 2. The damper blade 36 is movable selectively toward an open position for faster burning of fuel and toward a closed position for slower burning of fuel.

The rear wall 24 of the heating chamber 21 carries a flue collar 38 which receives a conventional flue pipe indicated generally at 39. The flue pipe 39 thus defines a discharge port for products of combustion.

As shown in FIGS. 2 and 4, horizontally spaced draft regulators 40 are carried by the lower portion of the door 17 and have suitable passageways therethrough for introducing controlled amounts of combustion air into the lower portion of the combustion chamber 10 for fast burning of fuel. At least one draft regulator 41 is carried by the upper portion of the door 17 for introducing controlled amounts of combustion air into the upper portion of the combustion chamber 10 for slow burning of fuel. As shown in FIG. 2, the upper draft regulator 41 is preferably mounted in a vertical plane which passes between the horizontally spaced regulators 40. The draft regulators 40 and 41 are shown as being identical and each comprises a threaded member 42 which is carried by and projects forwardly and outwardly of the door 17. Suitable vent passageways 43 are provided through the door 17 adjacent the threaded member 42, as shown in FIG. 4. A suitable control knob 44 is carried by each threaded member 42 for movement selectively toward and away from the vent passageways 43.

As shown in FIGS. 1 and 3, the heating chamber 21 is shown as extending almost the length of the combustion chamber 10 whereby the products of combustion entering the forward portion of the heating chamber 21 pass a substantial distance through the heating chamber 21 prior to being discharged through the outlet flue 39 whereby the combustion gases and heat from such gases are maintained inside the heater unit for a longer period of time, thereby minimizing loss of heat through the outlet flue.

As shown in FIGS. 3 and 5, an elongated passageway 46 is provided in the wall 22 between the flue collar 38 and the rear portion of the upstanding flange 32 that surrounds the discharge passageway 31. Accordingly, any distillate flowing from the outlet flue 39 into the heating chamber 21 will drip through the passageway 46 and thus pass into the combustion chamber 10.

From the foregoing description, the operation of my improved fuel burning heater will be readily understood. For fast burning of the fuel, such as would occur when a fire is first started, the damper blade 36 is moved to opened position, the lower draft regulators 40 are opened and the upper regulator 41 is closed whereby combustion air enters the lower portion of the combustion chamber 10 and passes therethrough generally in the direction of the arrows 47. Accordingly, the combustion air passes directly in contact with the wood or other fuel positioned in the lower portion of the combustion chamber whereupon the products of combustion are then discharged through the passageway 31 to the outlet flue 39. The lower draft regulators 40 thus provide primary air below the fire which brings about a faster burning of the wood or other fuel. To provide for slow burning of the fuel, such as where it is desired to hold the fire at night, the damper blade 36 is moved to closed position, the draft regulators 40 are closed and the upper draft regulator 41 is open. The combustion air then passes into the upper portion of the combustion chamber and passes therethrough generally in the direction of the arrows 48 to provide secondary air above the wood or other fuel. Accordingly, the combustion air passing through the draft regulators 41 into the upper portion of the combustion chamber 10 moves in a gentle manner above the wood and then passes upwardly through the discharge passageway 28 into the forward end of heating chamber 21.

It will thus be seen that while the damper blade 36 is in the closed position, the products of combustion entering either the lower or upper portion of the combustion chamber 10 pass through the discharge passageway 28 into the forward portion of the heating chamber 21 whereupon the products of combustion then flow rearwardly through the heating chamber 21 to the outlet flue 39.

From the foregoing it will be seen that I have devised an improved fuel burning heater which is simple of construction, economical of manufacture and one which is particularly adapted for supplying combustion air selectively for fast burning of the fuel and slow burning of the fuel. By providing draft regulators 40 in the lower portion of the combustion chamber which supply combustion air into the lower portion of the combustion chamber 10, with the damper blade 36 in open position, the products of combustion flow upwardly through the discharge passageway 31 and thus provide for fast burning of the fuel. By closing the upper draft regulator 41 and moving the damper blade 36 to open position while the lower draft regulators 40 are open, all of the incoming combustion air passes through the lower portion of the combustion chamber 10 into direct contact with the fuel, such as wood. By closing the lower draft regulators 40 and opening the upper draft regulator 41, with the damper blade 36 moved to closed position, the fire may be held overnight. If more heat is desired, the lower draft regulators 40 are turned whereby they are opened to introduce the desired amount of combustion air. Accordingly, by adjusting the lower draft regulators 40 and the upper draft regulators 41 to selected positions and by varying the position of the damper blade 36, the amount of air passing in direct contact with the wood and the amount of air passing over the wood in the upper portion of the combustion chamber may be readily varied to maintain the fire whereby it burns at the desired rate. In actual practice, I have found that with proper draft adjustment and with the proper amount of wood loaded in the combustion chamber, the fire can be held for 12 to 17 hours.

While I have shown my invention in but one form, it will be obvious to those skilled in the art that it is not so limited but is susceptible of various changes and modifications without departing from the spirit thereof.

What I claim is:

1. A fuel burning heater comprising:

(a) a lower housing defining a combustion chamber with a door at the front thereof, (b) an upper housing defining a heating chamber above said combustion chamber with a discharge port for products of combustion at the rear of said heating chamber, (c) a common wall between said lower housing and said upper housing defining a top wall for said combustion chamber and a bottom wall for said heating chamber, (d) a first discharge passageway through said common wall adjacent the forward end thereof for conveying products of combustion from said combustion chamber into the forward portion of said heating chamber, so that at least a portion of said products of combustion are adapted to pass through said forward portion of said heating chamber prior to being discharged through said discharge port, (e) a second discharge passageway through said common wall adjacent the rear end thereof for conveying products of combustion from the rear portion of said combustion chamber into the rear portion of said heating chamber, (f) a damper member mounted for movement relative to said second discharge passageway selectively toward an open position for faster burning of fuel and toward a closed position for slower burning of fuel, (g) lower draft regulator means adjacent the lower portion of said door for introducing controlled amounts of combustion air into the lower portion of said combustion chamber, and (h) upper draft regulator means adjacent the upper portion of said door for introducing controlled amounts of combustion air into the upper portion of said combustion chamber.

2. A fuel burning heater as defined in claim 1 in which an upwardly and forwardly extending deflector member is carried by said common wall adjacent the rearmost side of said first discharge passageway in position to direct said products of combustion toward the front end of said heating chamber.

3. A fuel burning heater as defined in claim 1 in which said damper member comprises a blade mounted for pivotal movement in said second discharge passageway and a handle-like member operatively connected to said blade.

4. A fuel burning heater as defined in claim 1 in which a drip passageway for distillate is provided through said common wall adjacent and rearwardly of said second discharge passageway.

* * * * *